US006079901A

United States Patent [19]

Banks et al.

[11] Patent Number: 6,079,901

[45] Date of Patent: Jun. 27, 2000

[54] PAVING MACHINE CAPABLE OF SPRAYING A LIQUID BINDING MATERIAL

[75] Inventors: Bradford H. Banks, Clarence; Joseph A. Kowalski, Buffalo, both of N.Y.

[73] Assignee: Midland Machinery Co., Inc, Tonawanda, N.Y.

[21] Appl. No.: 08/909,791

[22] Filed: Aug. 12, 1997

[51] Int. Cl.[7] ..... E01C 19/18

[52] U.S. Cl. ..... 404/108; 404/111; 239/128

[58] Field of Search ..... 404/108, 111; 239/128, 129, 135, 146; 298/24

[56] References Cited

U.S. PATENT DOCUMENTS

| | | | |
|---|---|---|---|
| 1,158,503 | 11/1915 | Johnston | 404/111 X |
| 4,702,642 | 10/1987 | Musil . | |
| 4,801,218 | 1/1989 | Musil . | |
| 4,948,292 | 8/1990 | Haven et al. . | |
| 4,978,068 | 12/1990 | Eldridge | 239/129 |
| 5,069,578 | 12/1991 | Bense et al. . | |
| 5,100,277 | 3/1992 | Musil . | |
| 5,279,500 | 1/1994 | Perrin et al. . | |
| 5,356,238 | 10/1994 | Musil et al. . | |
| 5,401,115 | 3/1995 | Musil et al. . | |
| 5,452,966 | 9/1995 | Swisher, Jr. . | |
| 5,529,434 | 6/1996 | Swisher, Jr. | 404/84.05 |

OTHER PUBLICATIONS

Here's How it works—Cedarapids Inc. remixing conveyor system; Asphalt Contractor, Feb., 1995.

Cedarapids Revolutionary Grayhound Remix Paver; Brochure published by Cedarapids Inc., Cedar Rapids, IA Jan. 1997.

Midland Mix–Paver 800 Brochure published by Midland Machinery Co., Inc., Tonawanda, NY, Sep. 1995.

Vogele Super 1800 SG Brochure published by Joseph Vogele AG, Mannheim Germany; 1994.

*Primary Examiner*—Tamara L. Graysay
*Assistant Examiner*—Sunil Singh
*Attorney, Agent, or Firm*—John C. Thompson

[57] ABSTRACT

The present invention relates generally to paving machines capable of spraying a liquid binding material in the form of an emulsion on the road surface prior to the application of a hot asphaltic bituminous concrete paving material. The paving machine including a self-propelled chassis having a hopper and a paving material accumulator on the front end for receiving paving material, a transversely extending spray bar at the rear of the chassis for spraying the liquid binding material on the surface of the road bed, a conveyor for conveying the paving material from the hopper to a discharge location to the rear of the spray bar, the conveyor including two or more conveying augers mounted in auger troughs, and auger covers from the accumulator to the discharge location, which cover reduces heat loss from the paving material. Additionally, a heating system is provided for directing hot engine exhaust gases beneath the covers initially for pre-heating and also to prevent the paving material in the troughs below the covers from cooling down once the paving operation has commenced.

9 Claims, 10 Drawing Sheets

PAVING MACHINE CAPABLE OF SPRAYING A LIQUID BINDING MATERIAL

TECHNICAL FIELD

The present invention relates generally to paving machines, and more particularly to a paving machine capable of spraying a liquid binding material in the form of an emulsion on the road surface prior to the application of a hot asphaltic bituminous concrete paving material.

BACKGROUND OF THE INVENTION

Paving machines are well known in the art which apply paving mixtures, such as a hot asphaltic bituminous concrete paving material, to the surface of the roadway. Self-propelled machines of this type typically have hopper at the front of the machine, a conveyor which extends from the hopper to the rear of the machine, and apparatus at the discharge end of the conveyor for spreading and smoothing the paving material onto the roadbed, which apparatus may include spreading screws in the form of transversely extending left and right augers which distribute the paving material, and a finishing screed at the rear of the machine for smoothing the spread paving material.

It is recognized, for example in U.S. Pat. Nos. 5,069,578 and 5,279,500, that may be desirable to apply a liquid binding material to the surface of a clean dry roadway. According to these patents the liquid binding material is applied at a location behind the propulsion means of the self-propelled machine and in front of the spreading screws and the smoothing table or screed. In U.S. Pat. No. 5,069,578 conveying means are disclosed which are of the drag slat type, the conveyor having upper and lower flights. The upper flight conveys the material to the rear of the machine. This form of conveyor has a disadvantage in that some of the paving material will adhere to the slats past the point where it is supposed to be discharged. This material is then carried back by the lower flight and may then drop either onto the surface of the roadway, or alternatively build up on the floor of the chassis of the self-propelled machine. It is undesirable that this material fall on the roadway because its presence on the roadway will prevent the application of liquid binding material to the roadway where there is already new, loose, extraneous paving material on the roadway.

The Vögele Super 1800 SF road paver is similar to U.S. Pat. No. 5,069,578 in that it discloses a paver having a spray assembly for spraying a bitumen emulsion just before the asphaltic paving material is placed on the surface of the roadbed. This paver includes a self propelled crawler unit having a hopper at the front, a spray bar to the rear of the crawler tracks, a pair of augers (or worm conveyors) which convey the material from the hopper to a location above and beyond the spray bar, spreading screws for spreading the delivered material, and a screed behind the spreading screws. The crawler chassis also supports an emulsion tank and an operator's station. It is an advertising feature of this machine that worm conveyors are provided to deliver the material from the feed hoppers to the transverse spreading screws, the product literature stating that "This modified conveyor system ensures that no paving material can drop onto the base not yet sprayed with emulsion." The Super 1800 SF road paver is designed for use with hot asphaltic bituminous concrete paving material. To this end the troughs beneath the worm conveyors are heated electrically to insure that if there is a work stoppage the material within the troughs will not cool down to such an extent that it would impede rotation of the worm conveyors. While the Vögele Super 1800 SF road paver performs in a satisfactory manner in many circumstances, particularly for narrow twisting roadways, it has significant disadvantages. Thus, the worm conveyors are open at the top. This will permit heat to escape, causing potential cool down problems to the hot mix. In addition, the crawler suspension system is not desirable in many applications since it limits the size of the machine to relatively small throughput. Also, the emulsion tank is relatively small.

OBJECTS AND SUMMARY OF THE INVENTION

It is the principal object of the present invention to provide an improved road paving machine which overcomes disadvantages of prior art paving machines.

More particularly, it is an object of the present invention to provide a paving machine capable of spraying a liquid binding material on a clean road surface prior to the application of paving material, the paving machine including a self-propelled chassis having a hopper and a paving material accumulator on the front end for receiving paving material, a transversely extending spray bar at the rear of the chassis for spraying the liquid binding material on the surface of the road bed, and conveyor means for conveying the paving material from the hopper to a discharge location to the rear of the spray bar, wherein the conveyor means includes two or more conveying augers mounted in auger troughs, and wherein each of the conveying augers is covered with an auger cover from the accumulator to the discharge location, which cover reduces heat loss from the paving material.

It is a further object of the present invention to provide a paving machine of the type set forth above wherein the auger conveyors have variable flighting, the flighting on the auger conveyors being more closely spaced together in the vicinity of the hopper than at the point of discharge.

Another object of the present invention is to provide a paving machine which includes paving material conveyors which extend from a front hopper to discharge location, and wherein novel means are provided for heating the paving material as it is being conveyed.

The above objects and other objects and advantages of this invention will become more apparent after a consideration of the following detailed description taken in conjunction with the accompanying drawings in which a preferred form of this invention is illustrated.

DETAILED DESCRIPTION

Figure 1:
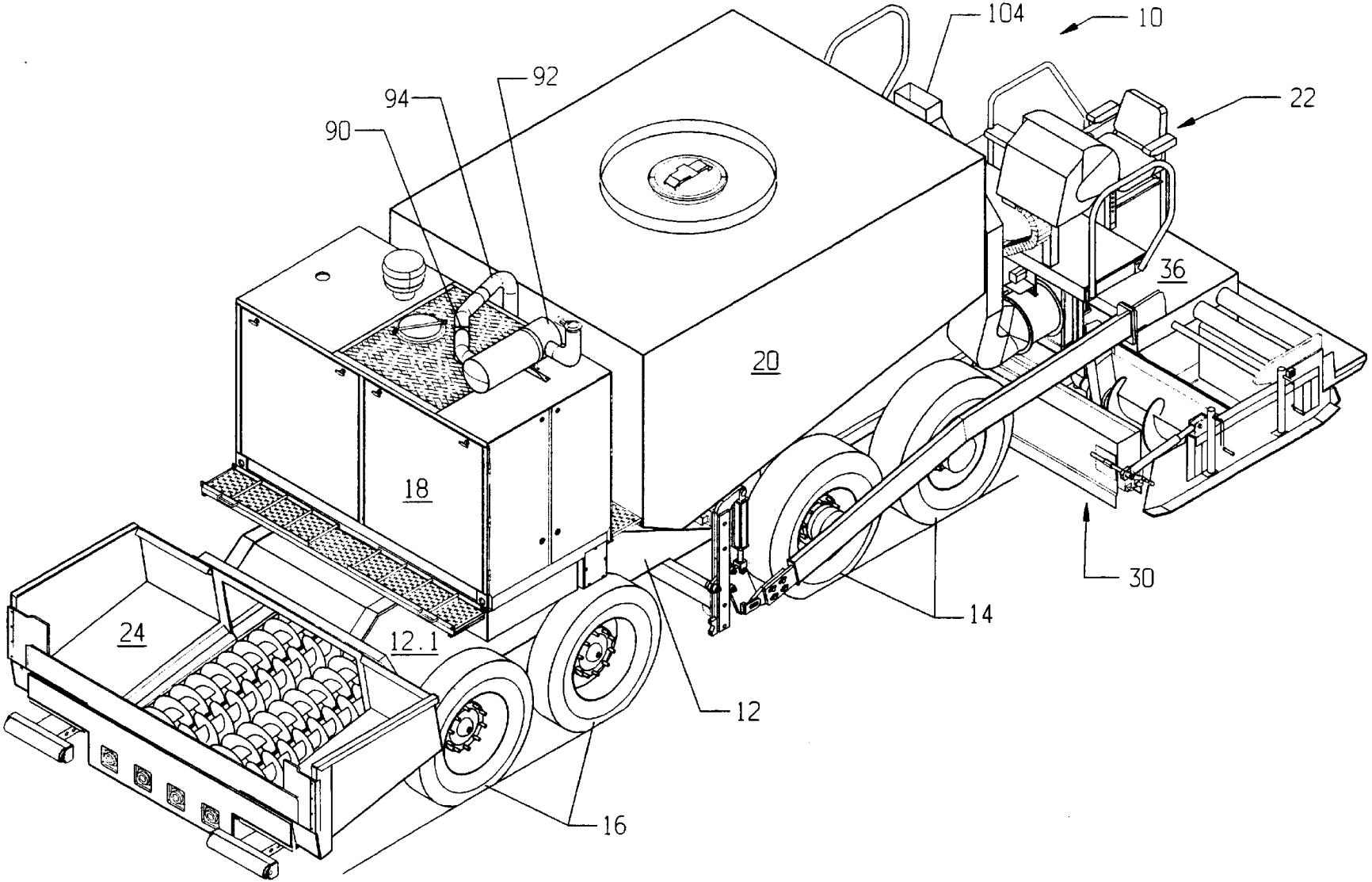
FIG. 1 is an isometric view of a road paver which incorporates the principles of the present invention, this view being taken from the front left side of the machine.
Figure 2:
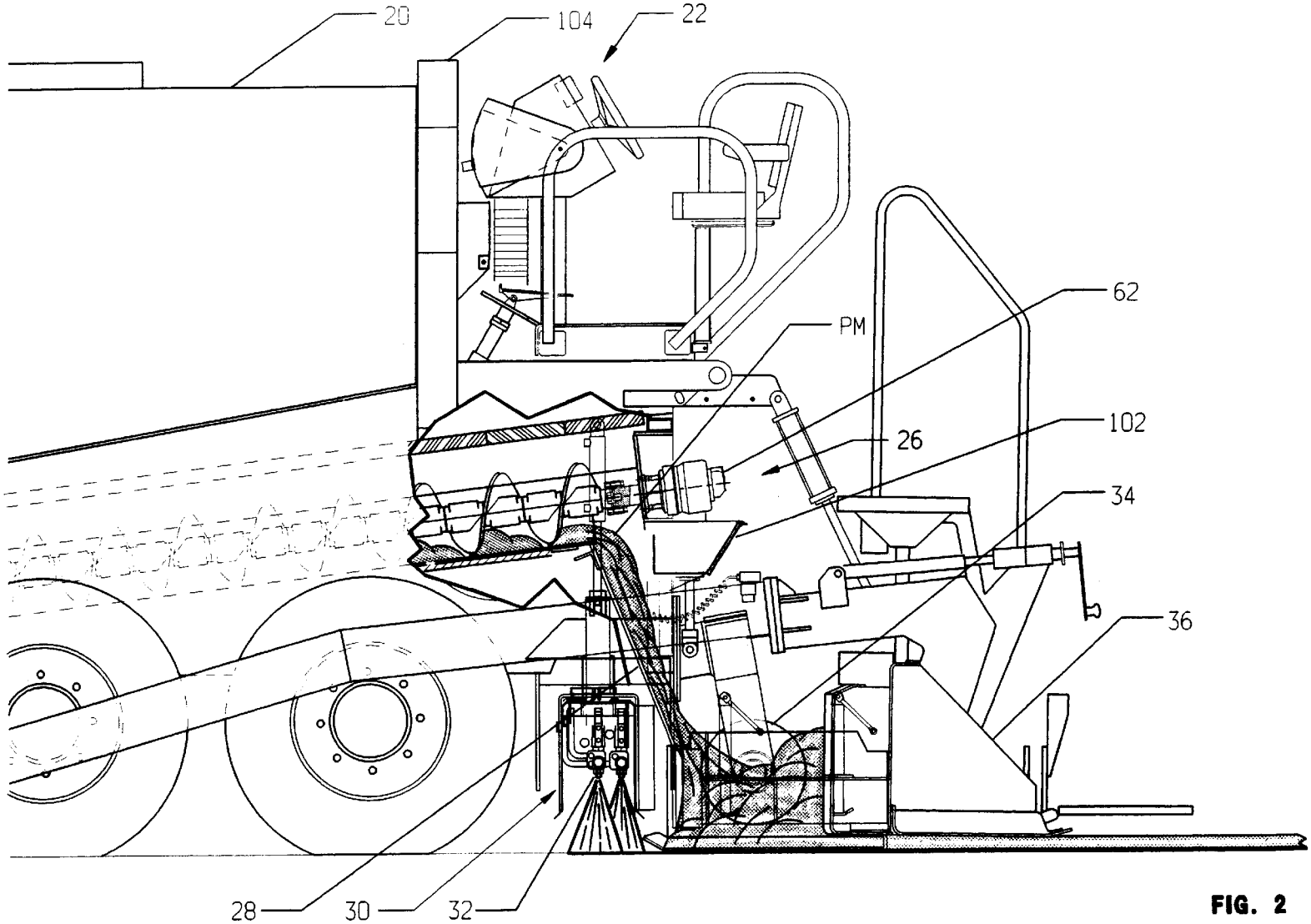
FIG. 2 is a left side elevational view of the rear end of the road paver of this invention, a portion being shown in section.

With reference now to the various drawings, right and left references are determined from standing behind the machine and facing its direction of travel. Similarly, front and rear references are determined by the normal operation of the machine with the operator facing in a forward direction. The paving machine in which the principles of this invention are incorporated is indicated generally at 10 in the drawings, which drawings are scale drawings. The paving machine includes a chassis 12 in the form of a weldment best shown in FIG. 4. The chassis is supported by drive wheels 14 and steering wheels 16. The drive wheels are powered by a conventional drive train interconnected with an engine mounted within an engine compartment 18, the engine compartment being mounted on the forward portion of the chassis above the steering wheels 16. To the rear of the engine compartment is an emulsion tank 20 which receives the liquid binding material which is to be applied to the roadbed prior to the application of a hot asphaltic bituminous concrete paving material. To the rear of the emulsion tank 20, an operator's station is mounted upon the chassis, the operator's station being indicated generally at 22. The operator's station can be incrementally moved from one side of the machine to the other, from a location 24 inches to the left of tank 20, to a location 24 inches to the right of the tank. A hopper 24 is located forward of the engine compartment 18, the steering wheels 16, and a front tunnel portion 12.1 of the chassis, which hopper is adapted to receive the paving material to be applied by the paving machine. Extending from the hopper through the chassis and below the engine compartment and emulsion tank is a conveyor assembly which is indicated generally at 26. The conveyor assembly, which will be described in greater detail below, discharges hot asphaltic paving material onto a chute 28 (FIGS. 2 and 4) where it will then descend to the surface of the roadbed. As can best be seen from FIG. 2, the chute is located above and behind a spray bar assembly 30 which carries spray nozzles 32 which spray a binding material on the roadbed. Thus, the hot asphaltic bituminous concrete paving material is received on the roadbed which has previously been coated with a binding material. The paving material is then spread and smoothed by conventional equipment such as spreading augers 34 and a variable width screed 36. The details of the propulsion system, operator's station, spray bar assembly and spray nozzles, spreading augers, and variable width screed form no part of the present invention and will not be described further.

Figure 4:
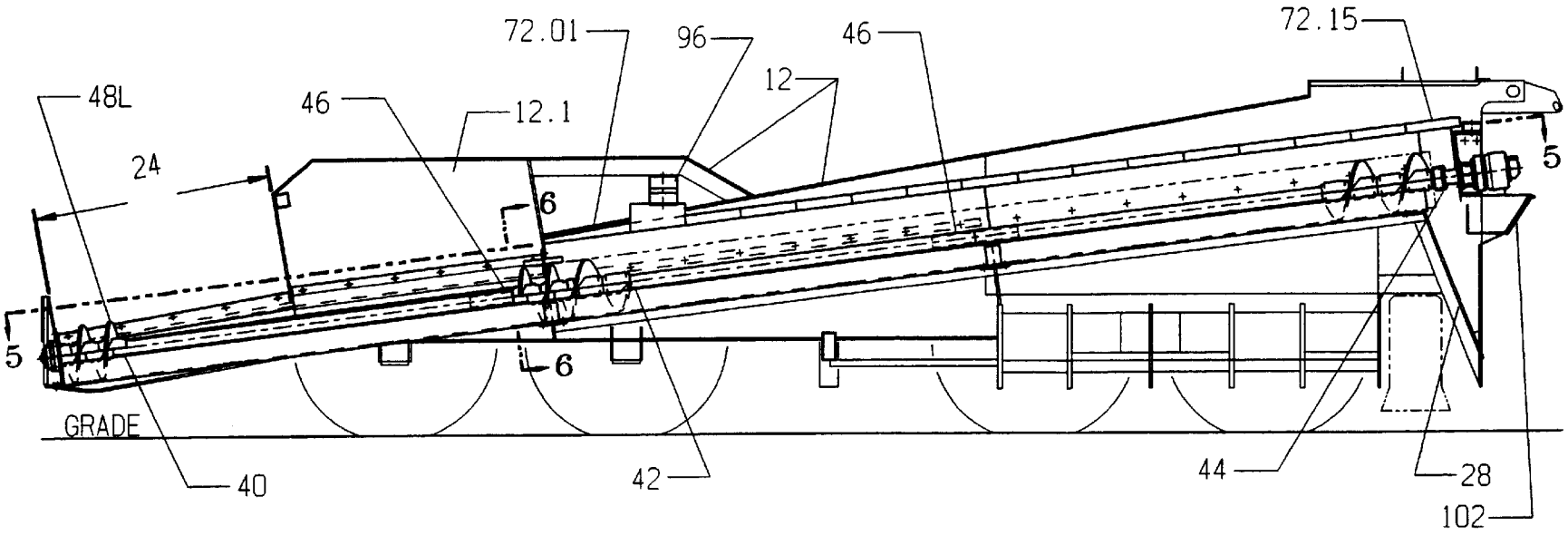
FIG. 4 is a side elevational view of the chassis weldment of the road paver of this invention, the conveying augers, auger troughs, auger covers, and the conveyor drive means.
Figure 5:
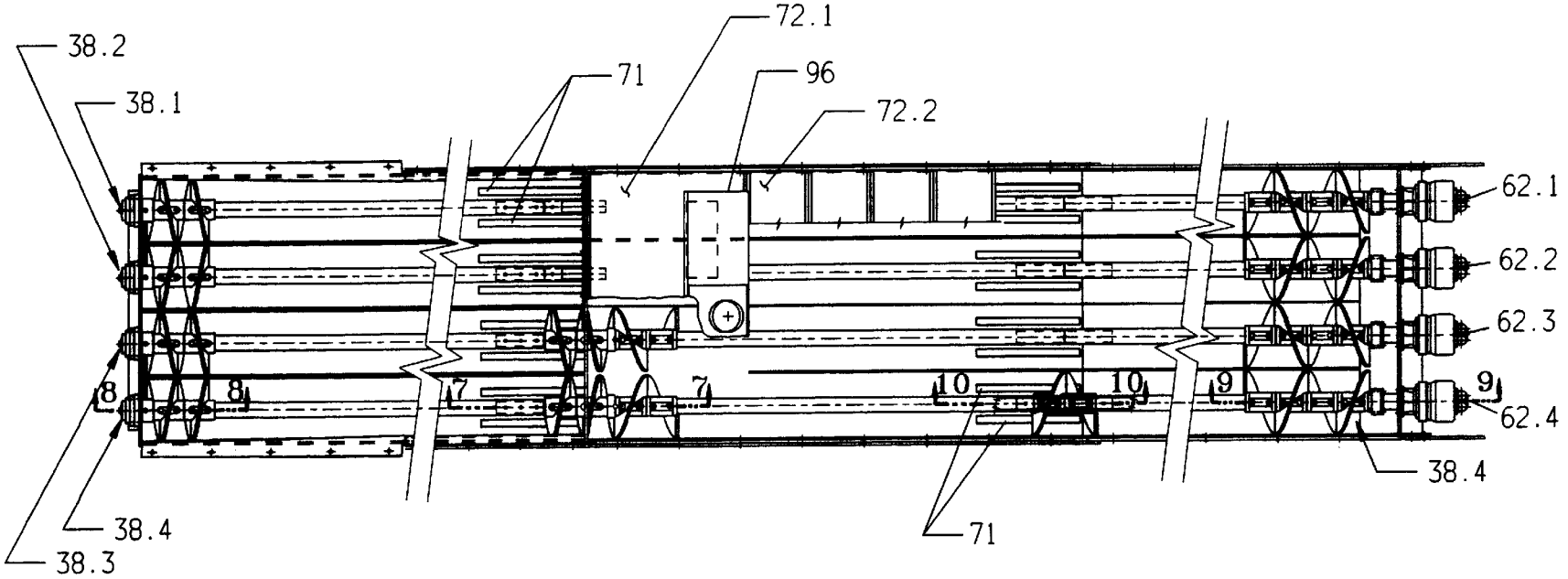
FIG. 5 is a sectional view taken generally along the line 5—5 in FIG. 4.

With reference now to FIGS. 4 and 5, the conveyor assembly of this invention includes four parallel conveying augers indicated generally at 38.1 through 38.4. Each of the conveying augers is assembled of a number of differing components and are essentially identical to each other with the exception that conveying auger assemblies 38.1 and 38.3 have right hand pitch screws and are rotated in a clockwise direction when viewed from the operator's station, and augers assemblies 38.2 and 38.4 are provided with left hand pitch screws and are rotated in a counterclockwise direction when viewed from the operator's station.

With reference now to the conveying auger 38.4, it can be seen from particularly FIGS. 4–10, that this conveying auger is made up of three separate auger shafts, a front shaft 40, a middle shaft 42, and a rear shaft 44. As can best be seen from FIGS. 7 and 10, these shafts are hollow. They are coupled together by means of coupling shafts 46 in a manner which will be more fully described below. Mounted upon the shafts 40–44 of auger 38.4 are hub and screw segments, screw segments 48L being a 12 inch diameter left-handed screw with a 6" pitch mounted on hub 49 and screw segments 50L being a 12 inch diameter left-handed screw with a 12" pitch mounted on hub 51. As can be seen from the various figures, the hub and screw segments are positioned on the shafts 40—44 to their proper locations and are secured in place by suitable cap screws and nuts (no reference numeral). If the hub and screw segment 48L or 50L is at the end of a shaft, the fasteners will not only secure the hub and screw segment to the shaft, but will also secure adjacent shafts together via the coupling shafts 46, this feature being shown best in FIG. 10.

The construction of the conveying auger assembly 34.2 will be substantially identical to that of auger assembly 34.4, described above in the preceding paragraphs. Auger assemblies 34.1 and 34.3 will be similar, the only difference being that hub and screw segments will be provided with right-handed screws 48 and 50 instead of left-handed screws. While hub and screws 48–51 are shown, the hubs may be eliminated, with the augers being welded directly to the auger shafts 40, 42 and 44. Cap screws and nuts would still be used to secure adjacent ends of auger shafts to coupling shafts 46.

Figure 8:
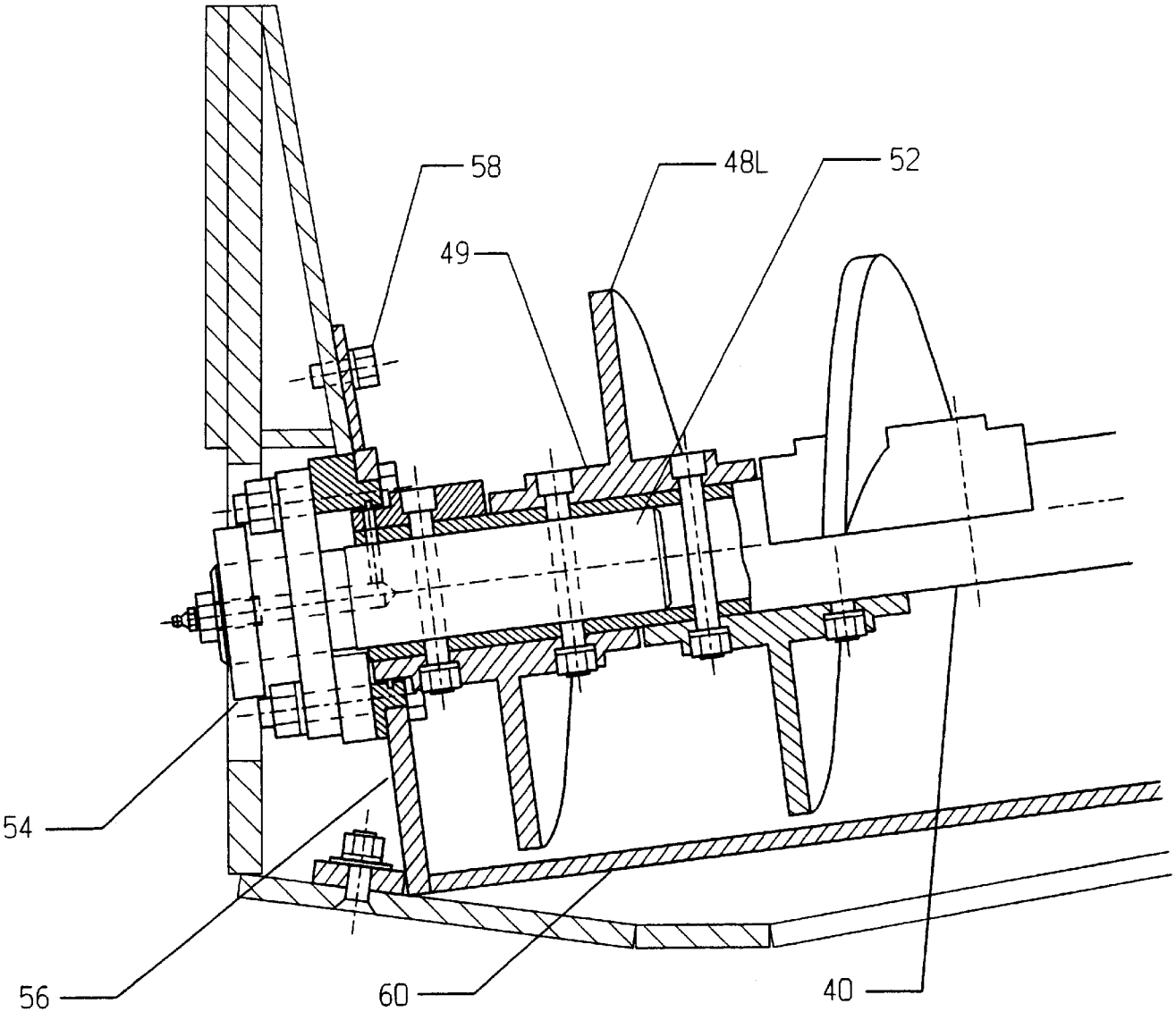
FIGS. 8, 9 and 10 are views taken generally along the sections lines 8—8, 9—9, and 10—10 in FIG. 5.

As can best be seen from FIGS. 4, 5 and 8, the front shaft 40 extends through the front tunnel portion 12.1 of the chassis and into the hopper 24. A stub shaft 52 which is rotatably supported by a bearing 54 is received within the very front hub and screw segment 48L, 49, as well as the leading end of the front shaft 40 and is secured thereto by suitable fasteners (no reference numeral). The bearing 54 is in turn interconnected with a plate assembly 56 normal to the axis of the shaft 40, the plate assembly 56 being interconnected with the front edge of the hopper by fasteners 58 and at its lower edge to a trough 60.

The rear end of each of the conveying augers 38.1 through 38.4 is interconnected with a variable speed hydraulic drive motor 62.1 through 62.4, respectively (FIG. 5). To this end each of the hydraulic motors is secured to a drive mount 64 (FIG. 9) of a generally box shaped construction, the drive mount in turn being secured to the chassis weldment by fasteners (no reference numerals). The rear shaft 44 is provided with a rear flange 44.1 which is in turn interconnected with a drive coupling 66 by suitable fasteners (no reference number), the drive coupling 66 in turn engaging the output shaft of the motor 62 via a key (no reference numeral). The drive coupling 66 is in turn held on the output shaft of the motor via a suitable nut 68.

Figure 6:
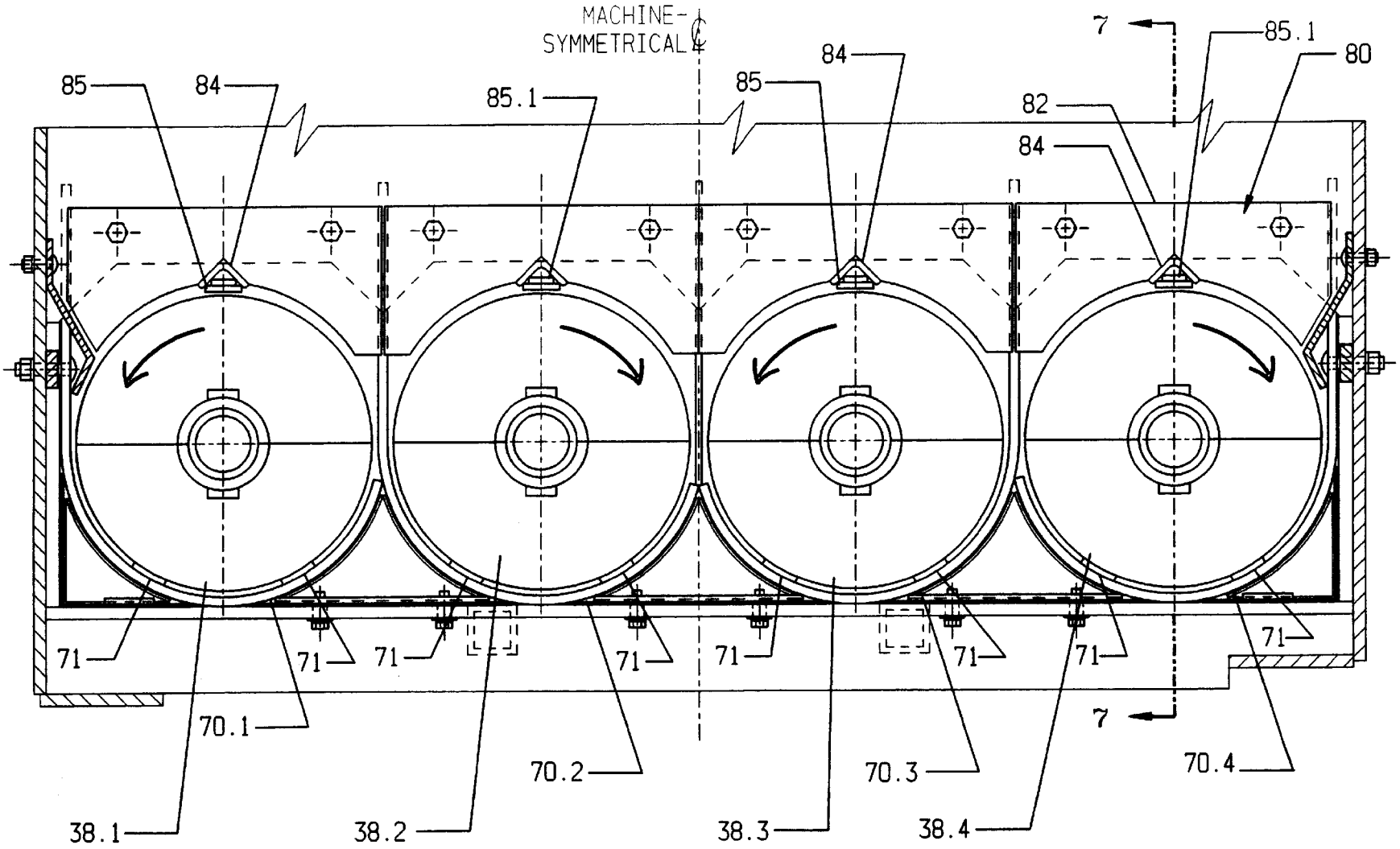
FIG. 6 is a cross-sectional view taken generally along the line 6—6 in FIG. 4.

As can best be seen from FIG. 6, each of the conveying augers 38.1 through 38.4 lies within an auger trough 70.1 through 70.4, respectively, each trough being in the shape of a segment of a cylinder and having a radius only slightly exceeding the radius of the screw on the associated conveying auger. Thus, it can be seen that augers 38.1 through 38.4 overlie auger troughs 70.1 through 70.4, respectively. The actual details of the auger troughs will not be described but it should be noted that there are front, middle and rear sections, and each of the sections is divided into left, right, left center, and right center. Thus, there are twelve trough sections in the assembly shown in the various drawings. In addition, each auger trough is provided with wear strips 71 formed of a hard steel.

Figure 9:
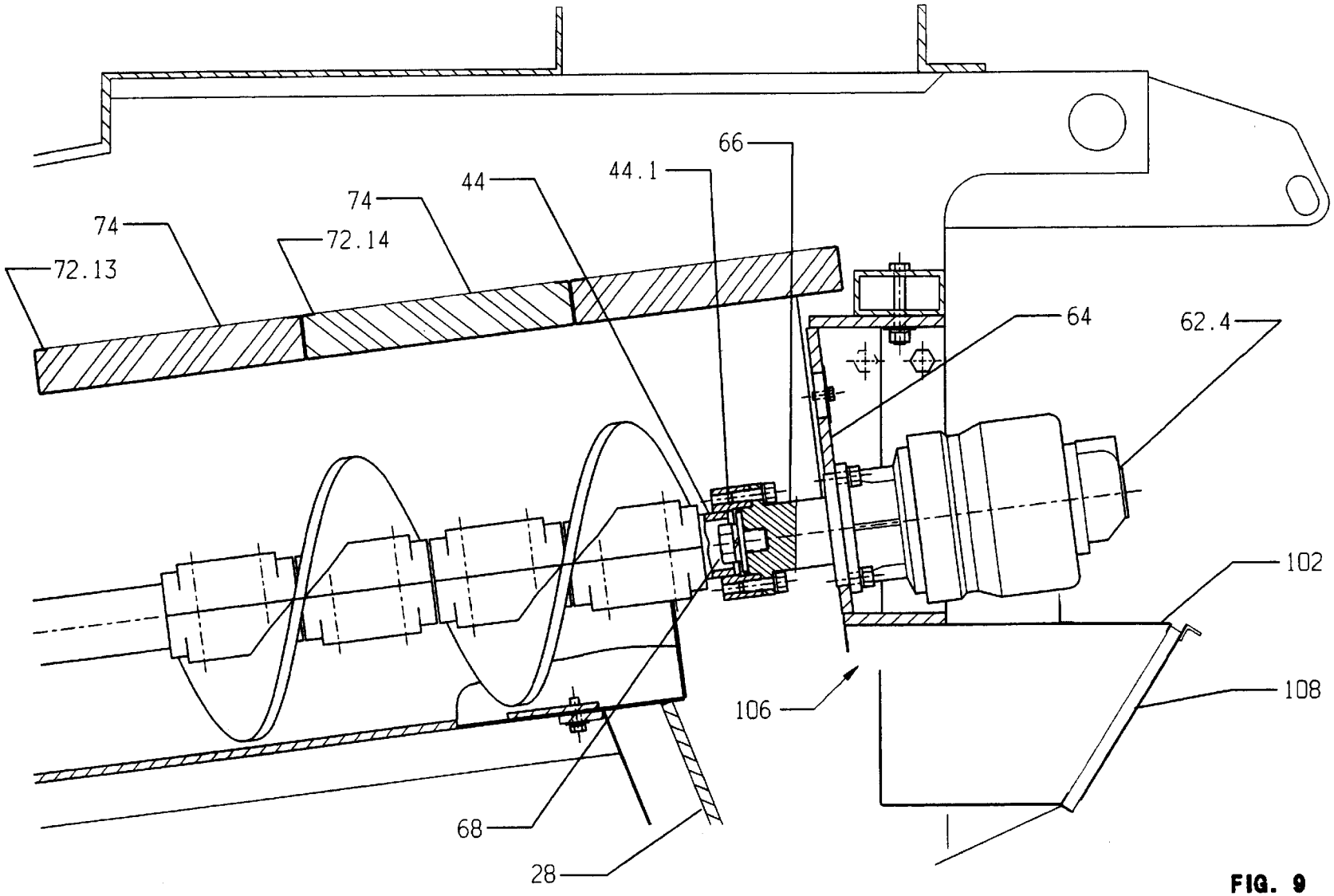
Figure 10:
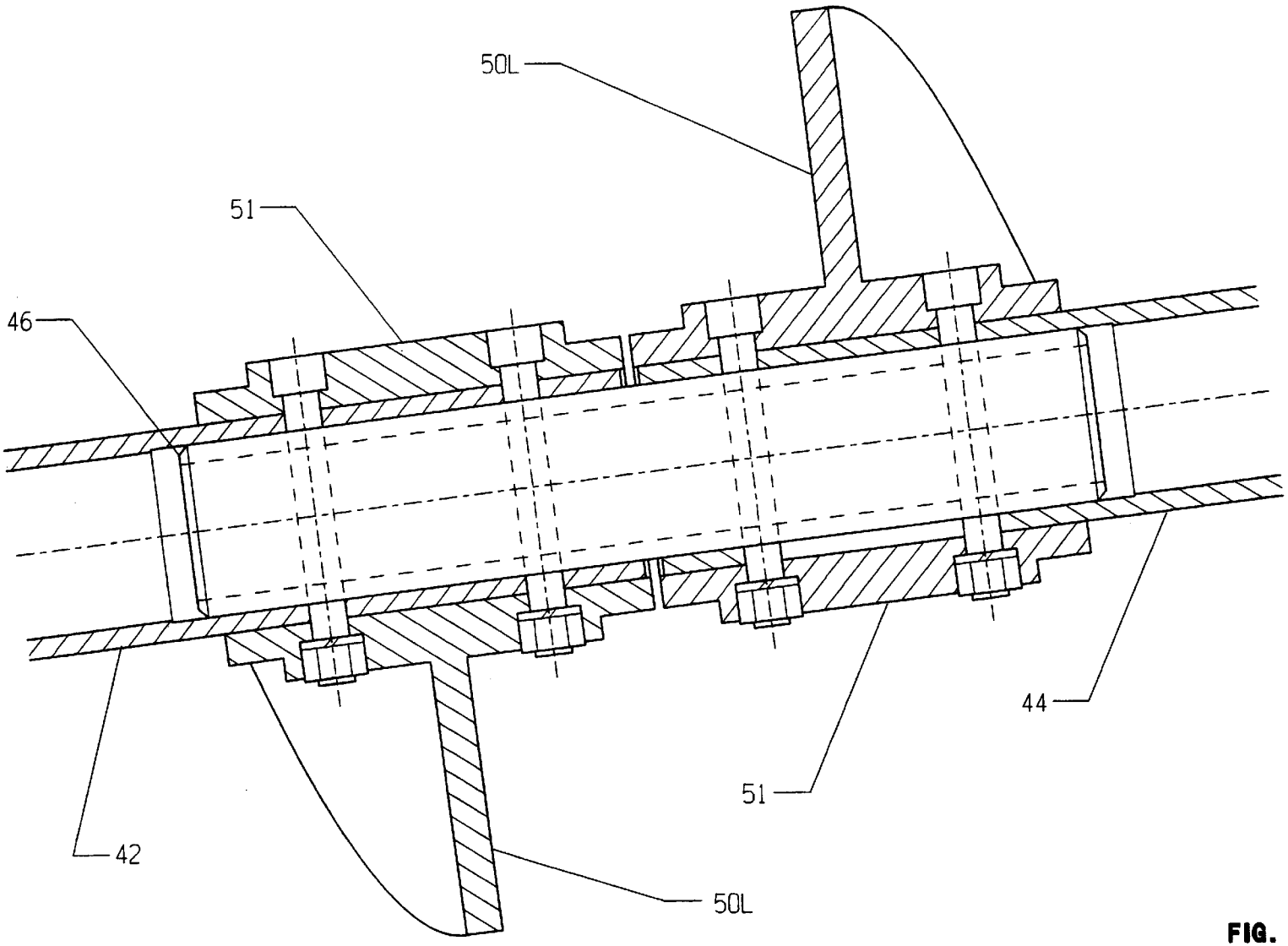

Welded or otherwise rigidly secured to the chassis weldment 12 are a plurality of abutting auger covers which extend across the full width of the augers 38.1 to 38.4 from the left side of the chassis to the right side. The front cover 72.01 is disposed immediately behind the tunnel 12.1, and the fourteen covers 72.02 to 72.15 are identical, the last cover 72.15 being disposed above and beyond the discharge chute 28. The cross-sectional view of the auger covers is best illustrated in FIG. 9, and it can be seen that each of the covers 72.02 to 72.15 is of a generally U-shaped channel configuration which is spaced away from the top surface of the upper flights a distance approximately equal to the radius of the flights. Each of the channels is filled with insulation 74.

Figure 7:
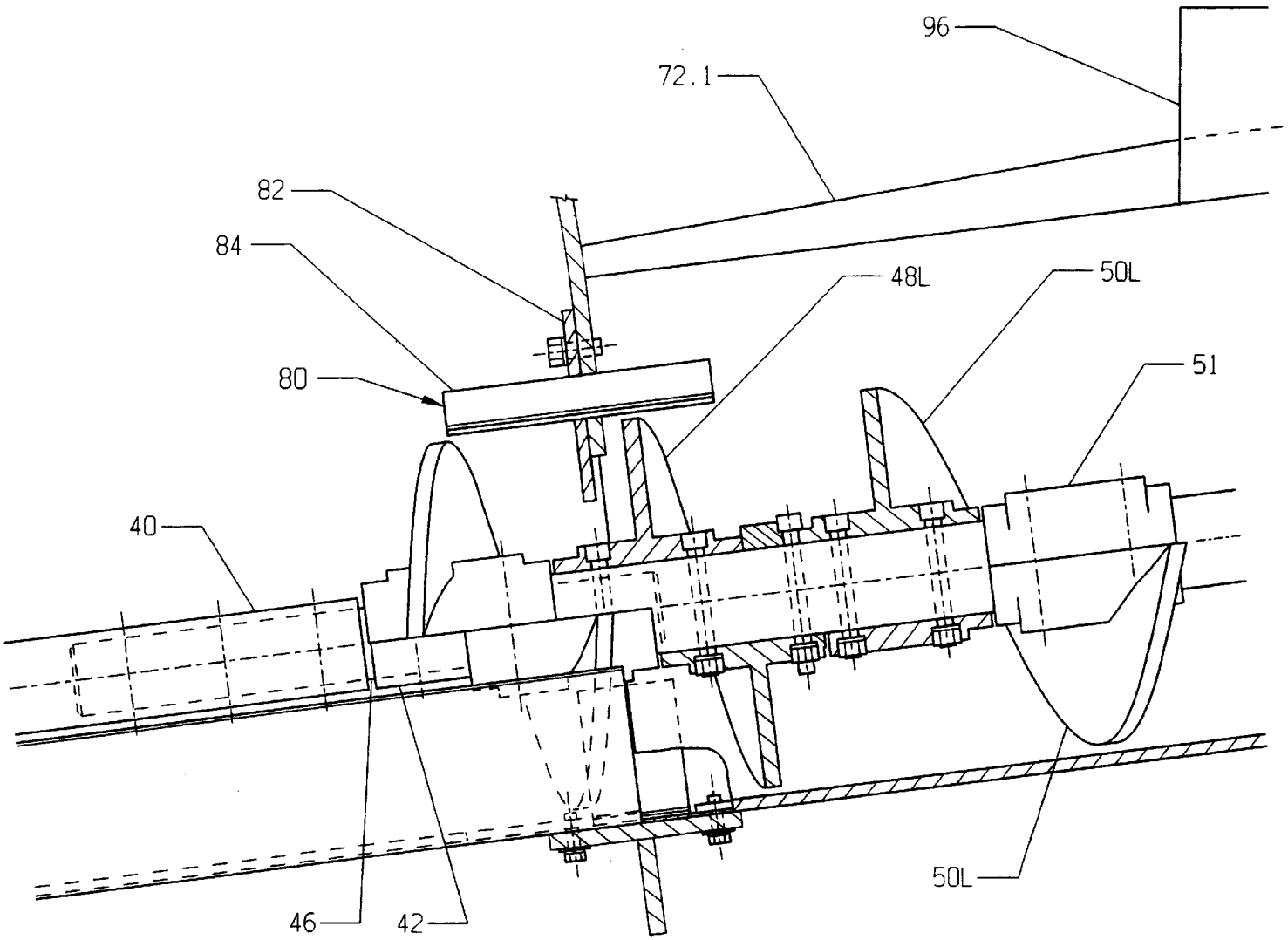
FIG. 7 is a view taken generally along the line 7—7 in FIG. 6.

The conveyor means of this invention further include a bulkhead or flow guide indicated generally at 80 in FIG. 7. The flow guide includes a plate 82 which is secured at its upper end by a conventional fastener (no reference number) to the rear surface of the front tunnel portion 12.1 of the chassis as best shown in FIG. 7, the plate having a circular cutout on its lower edge which conforms generally to the radius of the flighting on each associated conveying auger 38. However, at the very center of the circular cutout is a V-shaped notch for the reception of an inverted V-shaped bar 84 which is welded thereto. As can best be appreciated from an inspection of FIGS. 6 and 7, each V-shaped bar has a hard steel wear strip 85 welded thereto, the wear strip being backed up by a mild steel backup strip 85.1. The wears strips 85 will limit the possible upward movement of the associated auger and may also scrape its surface. As the plate 82 limits the quantity of material which may be conveyed beneath the covers 72, the front tunnel portion 12.1 acts as a paving material accumulator. Thus, material placed in the hopper 24 will be moved rearwardly at a rate which may exceed the rate which can pass the bulkhead 80, thus accumulating in the tunnel portion 12.1. If too much material accumulates within this portion, then it will be necessary to hold up delivery to the hopper until it can accept more material. While four plates 82 are shown, they may in fact be formed from a single plate.

Figure 3:
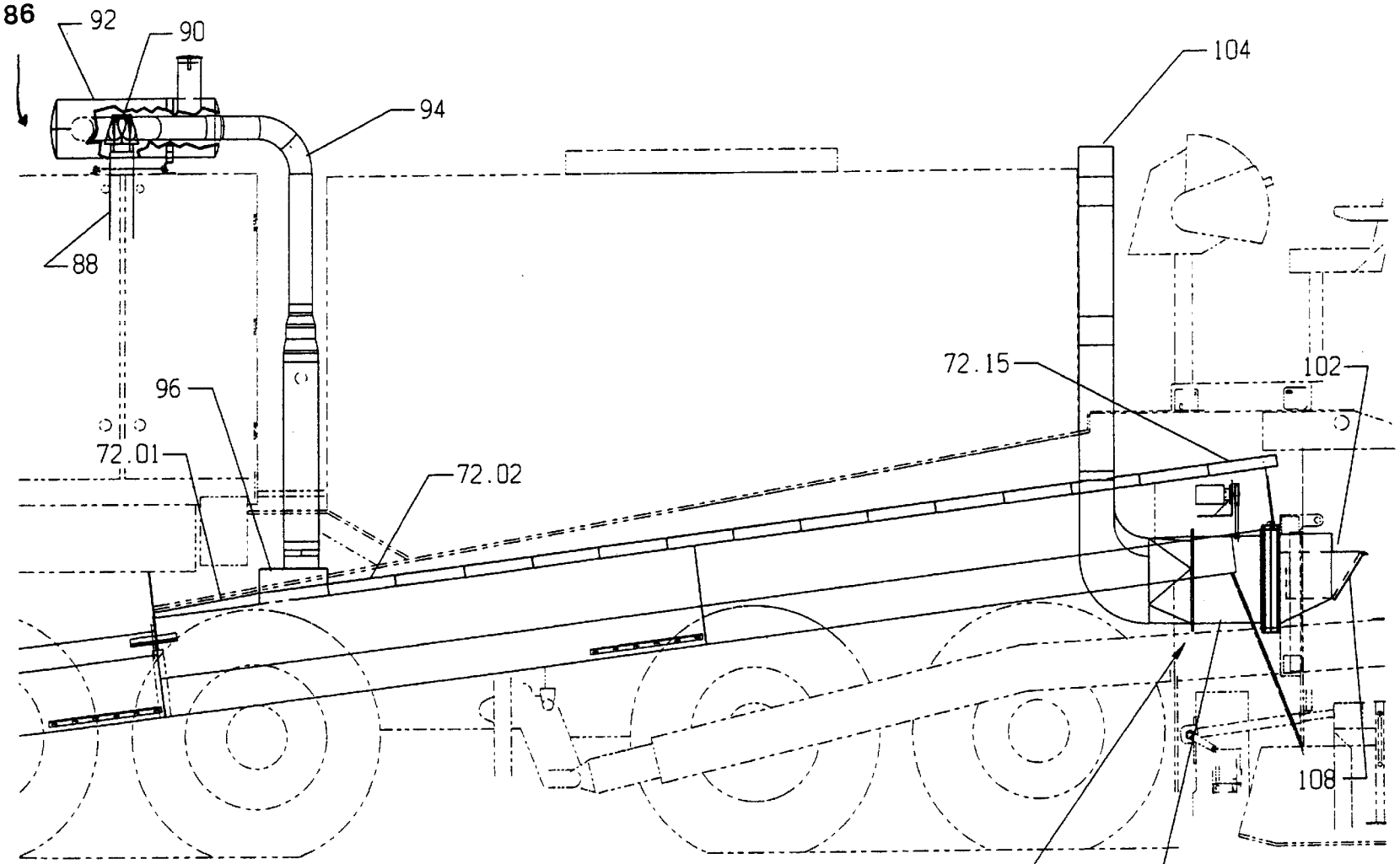
FIG. 3 is a left side elevational view of heating means.

It is a feature of this invention that heating means indicated generally at 86 in FIG. 3 are provided to initially warm the portion of the augers which extend from the accumulator to the discharge, as well as the associated auger troughs and covers, and also to prevent the paving material below the covers from cooling down once the paving operation has commenced. To this end, engine exhaust pipe 88 is provided with a manually operated two-position valve 90 which may divert hot exhaust gases either to a muffler 92 when in one position, or to a pipe 94 when in the other position. The pipe extends to a manifold 96 which is open at the bottom, the manifold 96 being mounted on the front cover 72.01. The cover is suitably apertured so that hot exhaust gases may flow through the manifold, through the cover 72.01, and then under covers 72.02 to 72.15.

At the rear end, a fume exhaust assembly 98 is provided which includes a fan in fan housing 100, a collector manifold 102 and exhaust stack 104. The collector manifold is provided with a front inlet 106 for receiving exhaust gases, and also a rear filtered inlet 108 for receiving steam from the spray material which has been contacted by the hot asphaltic paving material. In operation, exhaust gases and steam will be collected in manifold 102 and then be discharged in an upwardly direction above the operators station.

In operation, the tank 20 will be provided with a liquid binding material emulsion. During operation, hot asphaltic bituminous concrete paving material will be placed in the hopper 24 after the commencement of rotation of the augers at an appropriate speed. As the paving machine is propelled in a forward direction, the emulsion will be sprayed onto the road surface, and the augers will discharge the paving material over the chute 28 and in front of the spreading augers 34 and the variable width screed 36. It should be noted that during operation the auger covers 72 will retain heat of the hot bituminous paving material. Also, the exhaust gas from the engine will be used to preheat the augers and auger troughs below the covers prior to the commencement of operation.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A paving machine capable of spraying a liquid binding material in the form of an emulsion on the road surface prior to the application of a hot asphaltic bituminous concrete paving material; the paving machine comprising:

a chassis having an operator's station;

propulsion means interconnected with the chassis to propel the chassis in a forward direction over the surface of the roadbed;

a hopper supported on the front of the chassis for receiving hot asphaltic bituminous concrete paving material;

conveyor means for conveying the paving material from the hopper to a discharge location at the rear of the chassis and to the rear of the propulsion means;

a transversely extending spray bar carried by the chassis for spraying liquid binding material on the surface of the roadbed, the spray bar being located in front of the discharge location of the conveyor and to the rear of the propulsion means; and apparatus interconnected with the chassis for spreading and smoothing the paving material which has been discharged by the conveyor means onto the liquid binding material which has been sprayed onto the surface of the roadbed;

the paving machine being characterized by conveyor drive means supported by the chassis;

two or more conveying augers, one end of each of the conveying augers being connected to the conveyor drive means;

a paving material accumulator to the rear of the hopper, the conveying augers extending into the hopper through the accumulator;

an auger trough underlying each of the conveying augers for its full length;

abutting auger covers which extend across the full width of the augers and extend from the saving material accumulator to the discharge location, the covers reducing heat loss from the hot asphaltic bituminous concrete paving material; and a flow guide mounted immediately before the front end of the auger covers at the rear of the accumulator, the flow guide having a circular lower surface which is of approximately the same radius as the augers.

2. The paving machine as set forth in claim 1 wherein the flighting of the conveying augers is more closely pitched within the hopper and the paving material accumulator than below the auger covers and adjacent the discharge location.

3. The paving machine as set forth in claim 1 wherein an inverted V-shaped bar is secured to the lower surface of the flow guide in such a manner that the lower surface of the inverted V-shaped bar will be in scraping engagement with the adjacent flighting of the conveyor augers, and limit bowing of the associated conveying auger during operation.

4. The paving machine as set forth in claim 1 wherein heating means is provided for directing hot gases beneath the auger covers initially for pre-heating and also to prevent the paving material in the troughs below the covers from cooling down once the paving operation has commenced.

5. The paving machine as set forth in claim 4 wherein the heating means includes an engine on the chassis, a manifold positioned above the front auger cover which is provided with an opening in communication with the manifold, and piping for directing hot exhaust gases from the engine to the manifold.

6. The paving machine as set forth in claim 5 wherein exhaust gas collection means are provided at the rear of the auger covers for collecting and discharging the exhaust gases in an upwardly direction above the operators station.

7. The paving machine as set forth in claim 1 wherein the auger covers are spaced above the conveying augers a distance not greater than the radius of the conveying augers.

8. The paving machine as set forth in claim 1 wherein the auger covers extend in a transverse direction.

9. The paving machine as set forth in claim 1 wherein the auger covers are channel shaped, each channel receiving insulating material.

* * * * *